US006854469B1

(12) United States Patent
Hancock et al.

(10) Patent No.: US 6,854,469 B1
(45) Date of Patent: Feb. 15, 2005

(54) METHOD FOR PRODUCING A REDUCED IGNITION PROPENSITY SMOKING ARTICLE

(76) Inventors: Lloyd Harmon Hancock, 3183 Rosebud Rd., Walnut Cove, NC (US) 27052; Vernon Brent Barnes, 154 Country Cir., Advance, NC (US) 27006; Carl Carlton Greene, Jr., 6120 Narrow Way La., Winston-Salem, NC (US) 27105; Robert Leslie Oglesby, 1259 Old Salem Rd., Kernersville, NC (US) 27284

( * ) Notice: Subject to any disclaimer, the term of this patent is extended or adjusted under 35 U.S.C. 154(b) by 130 days.

(21) Appl. No.: 09/892,834

(22) Filed: Jun. 27, 2001

(51) Int. Cl.[7] ..... A24C 5/14

(52) U.S. Cl. ..... 131/60; 131/67; 131/68; 131/69

(58) Field of Search ..... 131/88, 90, 92, 131/93, 96, 105, 58, 59, 66.1, 67, 68, 69

(56) References Cited

U.S. PATENT DOCUMENTS

| | | | | |
|---|---|---|---|---|
| 1,555,320 A | * | 9/1925 | Weil | 131/349 |
| 1,581,451 A | | 4/1926 | Knapp | |
| 1,999,222 A | | 4/1935 | Weinberger | |
| 1,999,223 A | | 4/1935 | Weinberger | |
| 1,999,224 A | | 4/1935 | Miles | |
| 2,013,508 A | | 9/1935 | Seaman | |
| 2,049,320 A | | 7/1936 | Ruben et al. | |
| 2,307,088 A | | 1/1943 | Whileley | |
| 2,335,432 A | | 11/1943 | Millett | |
| 2,512,414 A | | 6/1950 | Booth | |
| 2,666,437 A | | 1/1954 | Lattof | |
| 2,718,889 A | | 9/1955 | Claussen | |
| 2,998,012 A | | 8/1961 | Lamm | |
| 3,030,963 A | | 4/1962 | Cohn | |
| 3,165,105 A | | 1/1965 | Campbell | |
| 3,370,593 A | | 2/1968 | Owaki | |
| 3,409,021 A | | 11/1968 | Owaki | |
| 3,477,440 A | | 11/1969 | Licis | |
| 3,632,384 A | | 1/1972 | Saint-Pastou | |
| 3,633,589 A | | 1/1972 | Kahane et al. | |
| 3,903,899 A | | 9/1975 | Musillo | |
| 3,915,176 A | | 10/1975 | Heitmann et al. | |
| 4,061,147 A | | 12/1977 | Falchi | |

(List continued on next page.)

FOREIGN PATENT DOCUMENTS

| | | | | |
|---|---|---|---|---|
| EP | 0 262 550 B1 | | 4/1988 | |
| EP | 1 329 165 A1 | | 7/2003 | |
| GB | 1378169 | * | 12/1974 | A24C/5/50 |
| JP | WO/02/17737 A1 | | 3/2002 | |
| JP | WO/02/19848 A1 | | 3/2002 | |
| WO | WO 02/17737 A1 | | 3/2002 | |
| WO | WO 02/19848 A1 | | 3/2002 | |

OTHER PUBLICATIONS

US 3,692,313, 9/1972, Sexstone (withdrawn)*

Hauni Operating Manual, MAX2, No. 78, Jun. 1997, pp. 13–49 through 13–81.

*Primary Examiner*—Steven P. Griffin
*Assistant Examiner*—Carlos Lopez
(74) *Attorney, Agent, or Firm*—Brinks Hofer Gilson & Lione

(57) ABSTRACT

The present invention provides a smoking article having a reduced ignition propensity by reason of one or more cross-directional bands of an adhesive applied to the paper wrapper of the smoking article. The adhesive may be one of a cigarette seam adhesive, a filter plug wrap adhesive or a tipping paper adhesive conventionally used in the manufacture of cigarettes. A cigarette maker is modified to include the adhesive applicator apparatus of the invention which applies the adhesive bands to the paper wrapper in an in line process.

9 Claims, 1 Drawing Sheet

U.S. PATENT DOCUMENTS 4,077,414 A 3/1978 Baker et al.
4,169,278 A 9/1979 Roehlich et al.
4,174,720 A * 11/1979 Hall ..... 131/90
4,208,956 A * 6/1980 Hall ..... 493/46
4,239,591 A 12/1980 Blake
4,252,527 A * 2/1981 Hall ..... 493/45
4,291,713 A * 9/1981 Frank ..... 131/68
4,340,074 A 7/1982 Tudor
4,361,156 A * 11/1982 Hall ..... 131/90
4,412,829 A * 11/1983 Lebet et al. ..... 493/48
4,434,805 A * 3/1984 Hall ..... 131/362
4,450,847 A 5/1984 Owens
4,452,259 A 6/1984 Norman et al.
4,453,553 A 6/1984 Cohn
4,459,998 A 7/1984 Labbe et al.
4,480,650 A 11/1984 Weinert
4,489,738 A 12/1984 Simon
4,582,507 A * 4/1986 Grollimund ..... 493/381
4,583,558 A 4/1986 Luke
4,615,345 A 10/1986 Durocher
4,619,278 A 10/1986 Smeed et al.
4,622,983 A 11/1986 Mathews et al.
4,739,775 A 4/1988 Hampl, Jr.
4,781,203 A 11/1988 La Hue
4,889,145 A 12/1989 Adams et al.
4,945,932 A 8/1990 Mentzel et al.
4,998,542 A 3/1991 Kallianos et al.
5,060,675 A 10/1991 Milford et al.
5,170,128 A * 12/1992 Masurat et al. ..... 324/664
5,191,906 A 3/1993 Myracle, Jr.
5,200,020 A 4/1993 Collins et al.
5,263,500 A 11/1993 Baldwin et al.
5,263,999 A 11/1993 Baldwin et al.
5,314,559 A * 5/1994 Rinehart et al. ..... 156/356
5,342,484 A 8/1994 Cutright et al.
5,417,228 A 5/1995 Baldwin et al.
5,450,863 A 9/1995 Collins et al.
5,474,095 A 12/1995 Allen et al.
5,534,114 A 7/1996 Cutright et al.
5,634,477 A * 6/1997 Ogura et al. ..... 131/69
5,666,976 A * 9/1997 Adams et al. ..... 131/94
5,692,526 A * 12/1997 Adams et al. ..... 131/194
5,735,292 A * 4/1998 Draghetti ..... 131/34
5,878,753 A 3/1999 Peterson et al.
5,878,754 A 3/1999 Peterson et al.
5,997,691 A 12/1999 Gautam et al.
6,129,087 A 10/2000 Wallace et al.
6,543,457 B2 4/2003 Maiwald et al.
6,705,325 B1 * 3/2004 Hicks et al. ..... 131/34
2002/0023655 A1 * 2/2002 Fietkau ..... 131/284
2002/0129824 A1 9/2002 Hammersmith et al.
2002/0139381 A1 10/2002 Peterson et al.
2002/0179105 A1 12/2002 Zawadzki et al.
2003/0037792 A1 2/2003 Snaidr et al.
2003/0131860 A1 * 7/2003 Ashcraft et al. ..... 131/365

* cited by examiner

FIG. 1
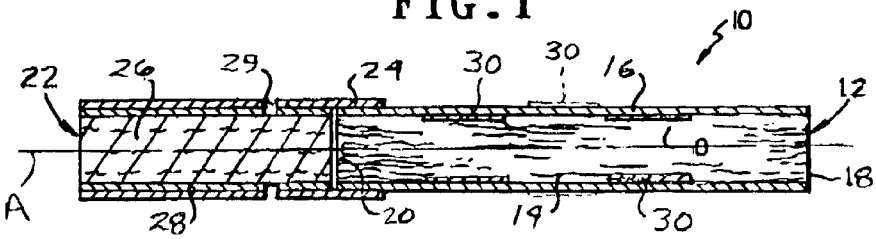
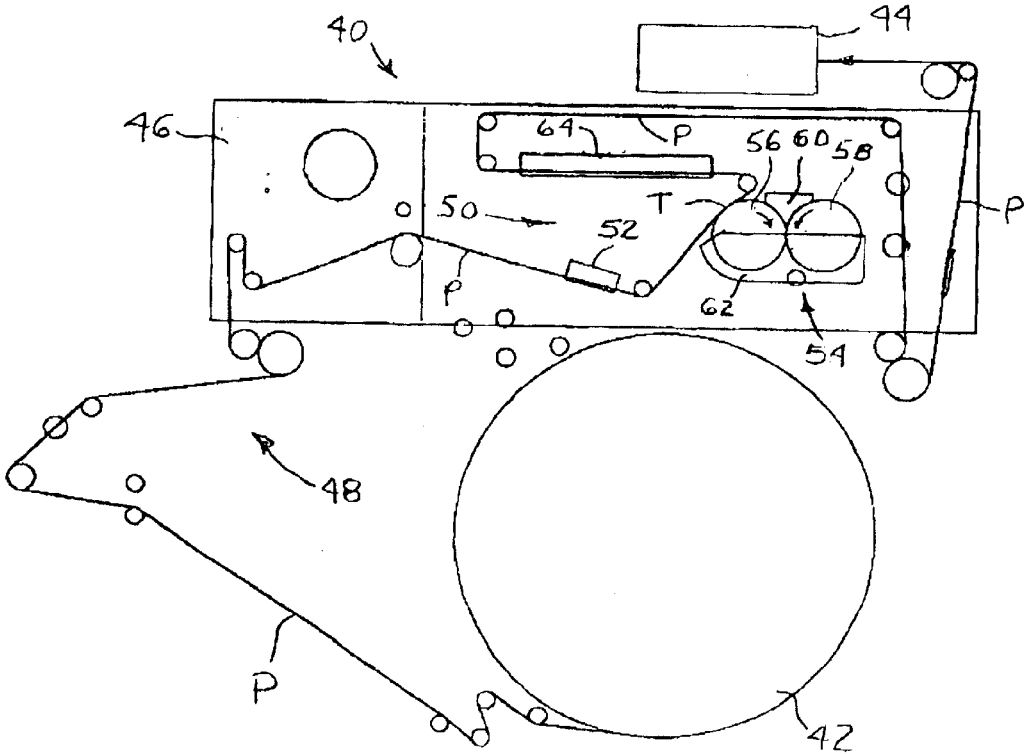
FIG. 2

METHOD FOR PRODUCING A REDUCED IGNITION PROPENSITY SMOKING ARTICLE

BACKGROUND OF THE INVENTION

1. Field of the Invention

The present invention relates to a smoking article and a wrapper for a smoking article that provide substantially reduced ignition propensity in the smoking article, particularly in a cigarette, and to an in line method of and apparatus for producing the wrapper and making smoking articles using the wrapper.

2. Description of the Prior Art

There is a recognition in the industry that the smoking article wrapper has a significant influence on the reduction of ignition propensity of the smoking article. Several solutions have been proposed to solve the problem of providing a low or reduced ignition propensity cigarette involving modification of the porosity of the smoking article wrapper.

For example, it is known that the burn characteristics of a wrapper can be modified by adding fillers, coatings or additives to the wrapper. U.S. Pat. No. 4,480,650 to Weinert discloses a self-extinguishing cigarette in which the interior surface of the wrapper is coated with clay. U.S. Pat. No. 4,889,145 to Adawns et al. discloses a cigarette wrapper having an area containing a discontinuous coating of porosity reducing composition. U.S. Pat. No. 4,615,345 to Durocher discloses a cigarette having cross-directional or circumferential bands treated with bum promoter wherein the untreated paper does not support combustion and the cigarette self-extinguishes when the cigarette burns into the untreated area of the wrapper. U.S. Pat. No. 4,453,553 to Cohn attempts to improve upon both sidestream smoke characteristics and fire resistance by the use of longitudinal stripes of burn rate reducing substances and optionally an additional layer of cigarette wrapper paper.

Modification of the smoking article wrapper by modifying the base paper properties in certain regions or applying to the base paper a cross-directional ring or band or a cross-directional strip of paper having different properties than the base paper have been proposed. For example, U.S. Pat. No. 4,945,932 to Mentzel et al. discloses a cigarette wrapper paper having annular zones of low permeability formed by a batonneing process. U.S. Pat. No. 4,739,775 to Hampl, Jr. discloses the application of circumferential bands of paper having reduced filler content onto the inside of the base paper to form smoking articles that are self-extinguishing in the two layer circumferentially banded zones. U.S. Pat. No. 5,474,095 to Allen et al discloses a wrapper paper having cross-directional or circumferential regions with increased basis weight that is produced in the papermaking process by depositing additional material onto the base web in the papermaking machine using a drum containing a plurality of slits.

The foregoing and other prior art attempts to reduce the ignition propensity of smoking articles, such as cigarettes, focus primarily upon creating zones of low permeability in the wrapper paper during the papermaking process and using the thus-formed paper slit to an appropriate width in the cigarette making process to form the outer wrapper for the cigarette. Insofar as is known, there has been no successful prior art process in which cross-directional zones of low or reduced permeability have been created on the cigarette wrapper paper in line, that is, during the cigarette making process.

In addition, the use of new chemical additives in a cigarette product to form low or reduced permeability zones of the cigarette wrapper paper to reduce the ignition propensity of the cigarettes is undesirable since such additives must undergo testing to insure that there are no adverse effects of adding the chemicals to the cigarettes.

It would be desirable to provide an in line process and apparatus for manufacturing a smoking article having reduced ignition propensity which does not require extensive equipment modifications or the use of new chemical additives that require extensive testing. It would also be desirable to provide a cigarette having reduced ignition propensity that can be made on slightly modified, conventional cigarette making machinery using readily available, conventional materials, including conventional wrapper papers and wrapper adhesives, without sacrificing the look, feel, taste and burn of a conventional cigarette or the speed and efficiency of the cigarette making machinery.

SUMMARY OF THE INVENTION

The present invention provides a smoking article, such as a cigarette, having reduced ignition propensity that is made with a paper wrapper provided in line with zones of low or reduced permeability using conventional materials on conventional cigarette making machinery modified in accordance with the invention. In accordance with an important aspect of the invention, a conventional cigarette maker, such as a Hauni Protos cigarette maker manufactured by Körber of Germany, is modified to incorporate between the garniture and the wrapper paper bobbin an apparatus for intermittently applying to the paper wrapper a material that lowers or reduces the permeability of the paper in a zone in which the material is applied.

According to another important aspect of the present invention, the low or reduced permeability zones applied by the apparatus to the paper wrapper are formed by an adhesive material conventionally used in the manufacture of cigarettes, such as the adhesive material conventionally used to bond the longitudinal seam of the wrapper paper ("the cigarette seam adhesive"), or the adhesive conventionally used to bond the filter plug wrap to a filter element ("the filter plug wrap adhesive"), or the adhesive conventionally used to bond a filter element to a tobacco rod with a tipping paper ("the tipping paper adhesive"). Preferably, the low or reduced permeability zones of adhesive material are applied by the apparatus of the invention as longitudinally spaced, cross-directional bands to the inside surface of the paper wrapper, that is, the surface of the paper wrapper on which the tobacco rod will be placed and formed in the garniture of the maker apparatus, or what will become the inner surface of the wrapper of the finished cigarette. The porosity of the paper at the bands where the adhesive is applied to the paper wrapper is preferably less than about 20 Coresta units and may be from about 0 Coresta units to about 20 Coresta units, preferably from about 0 Coresta units to about 10 Coresta units, and most preferably from about 0–6 Coresta units. According to the invention, the use of adhesives conventionally employed in the manufacture of a cigarette product to create zones of low or reduced permeability in a reduced ignition propensity cigarette advantageously eliminates the need for the cigarette manufacturer to perform extensive testing for any adverse effects to consumers who use the reduced ignition propensity cigarette.

As used in the specification and claims herein, the terms "cigarette seam adhesive," "filter plug wrap adhesive" and "tipping paper adhesive" include: (1) the specific longitudinal seam, plug wrap and tipping paper adhesive formulations that have been or may be employed by the assignee of this invention in the manufacture of cigarettes; (2) the specific longitudinal seam, plug wrap and tipping paper adhesive formulations that have been or may be employed by other cigarette manufacturers in the manufacture of cigarettes; and (3) variations of the specific formulations of (1) and (2) that make possible or facilitate the application of the adhesive to the wrapper paper for reducing paper permeability or that improve the reduction of paper permeability. In the case of aqueous cigarette seam adhesive formulations, aqueous filter plug wrap adhesive formulations, or aqueous tipping paper adhesive formulations, modified, for example, by an increase or decrease in the water content to facilitate drying of the applied adhesive or to vary adhesive viscosity for facilitating application of the adhesive to the paper in line or off line, are intended to be included within the meaning of the terms "cigarette seam adhesive," "filter plug wrap adhesive" and "tipping paper adhesive." Similarly, conventional adhesive formulations with an increase or decrease in the solids content of the formulations, for example, to alter the permeability characteristics of those portions of a paper to which one of the formulations is applied, are also intended to be included within the definition of the terms "cigarette seam adhesive," "filter plug wrap adhesive" and "tipping paper adhesive."

The smoking article of the invention comprises a rod of smokable material, such as tobacco, disposed in a wrapper and having a first end, a second end opposite the first end and a longitudinal axis extending from the first end to the second end. The wrapper of the invention comprises an elongated strip of paper material to which has been applied one or more bands, zones or regions of a cigarette seam adhesive, a filter plug wrap adhesive or a tipping paper adhesive in a cross-directional orientation which reduces the permeability of the paper in the band(s), zone(s) or region(s). As used in the specification and claims herein, the term "cross-directional" means in a direction transverse to the longitudinal axis of the paper strip, though not necessarily perpendicular to the longitudinal axis of the paper strip. The term "cross-directional" excludes the longitudinally-oriented cigarette seam adhesive of a conventional cigarette and any essentially longitudinally-oriented adhesive application to a cigarette, such as that disclosed in copending U.S. application Ser. No. 09/740,321 filed Dec. 18, 2000 and assigned to the assignee of the present invention.

The bands, zones or regions of the cigarette seam adhesive, filter plug wrap adhesive or tipping paper adhesive are preferably applied in line, that is, on the cigarette making machinery during manufacture of the cigarette by an apparatus constructed according to the invention. The in line apparatus of the invention generally comprises a paper preheater, a "glue pot" assembly and a paper dryer mounted in series on a conventional cigarette maker between the paper bobbin and the garniture of the cigarette maker. The wrapper paper is wound onto a large bobbin from which it is payed out as an elongated strip under slight tension as is conventional. The paper strip passes through the preheater where it is heated up to a temperature of from about 180° C. to about 220° C., and preferably a temperature of about 200° C. Preheating of the paper strip is optional, but it can advantageously assist in the evaporation of the adhesive solvent, e.g., water in the case of an aqueous-based adhesive. The preheater is preferably an IR (infrared) heater or other type of heater that has a relatively short response time, that is, heats up and cools down relatively quickly. A large mass heater or "block" heater is not preferred since it has a very long response time and could take an excessive time period to heat up during start-up of the cigarette maker and could scorch the paper strip when the maker speed is reduced.

The "glue pot" assembly comprises a pair of counter-rotating rollers, more specifically, a pattern roller and an application roller, that rotate at a circumferential speed identical to the payout speed of the wrapper paper strip. The rollers are partly enclosed in a drip box that catches any adhesive that drips, spatters or is thrown by centrifugal force from the rollers. An adhesive feed shoe is located between the counter-rotating rollers so as to feed the cigarette seam adhesive, filter plug wrap adhesive or tipping paper adhesive to the pattern roller immediately upstream of the nip between the rollers. The pattern roller is preferably a gravure or intaglio roller provided with a plurality of circumferentially spaced transverse grooves for transferring the adhesive to the application roller in circumferentially spaced locations on that roller. The application roller is positioned to bear with a slight upward pressure against the paper strip so as to transfer the adhesive to the preheated paper in longitudinally spaced, cross-directional bands of a predetermined width and spacing.

After the adhesive has been applied to the paper, the paper strip passes through an IR paper dryer downstream of the glue pot assembly and upstream of the garniture of the cigarette maker. The adhesive and paper are dried sufficiently in the IR paper dryer so that the paper with the spaced, cross-directional adhesive bands applied to it does not tear when it is wrapped about the tobacco rod in the garniture.

Although an important aspect of the present invention is the in line application of bands of adhesive to a paper wrapper for a smoking article to reduce ignition propensity of the smoking article, off line application of a cigarette seam adhesive, filter plug wrap adhesive or tipping paper adhesive during or after the papermaking process is also contemplated for the smoking article and paper wrapper of the invention.

With the foregoing and other objects, advantages and features of the invention that may become hereinafter apparent, the nature of the invention may be more clearly understood by reference to the following detailed description of the invention, the appended claims and to the several drawings forming a part hereof.

BRIEF DESCRIPTION OF THE DRAWINGS

FIG. 1 is a cross-sectional view of a cigarette smoking article of the invention having a paper wrapper made according to the invention; and FIG. 2 is a schematic side view of the apparatus of the invention for making the smoking article and wrapper according to the invention.

DETAILED DESCRIPTION OF THE INVENTION

Referring now to the drawings, an embodiment of a reduced ignition propensity smoking article of the present invention is shown in FIG. 1. A smoking article, shown in FIG. 1 as a cigarette 10, includes a generally cylindrical rod 12 of a charge or roll of smokable filler material 14 contained in a circumscribing wrapping material 16 with a longitudinal axis A. The wrapping material or wrapper 16 is preferably a paper material that overlaps along a longitudinal seam (not shown) at which the overlapping portions of the wrapper are bonded together with a cigarette seam adhesive in a conventional manner. The rod 12 is typically referred to as a "smokable rod" or a "tobacco rod." The cigarette 10 has a first free end 18 and a second end 20 opposite the first end 18. The ends 18, 20 of the tobacco rod are "open," i.e., are not covered by the paper wrapper material 16.

The cigarette 10 typically includes a filter element 22 or other suitable mouthpiece attached at the second end 20 of the tobacco rod 12 by means of a circumscribing tipping paper 24 such that the filter element 22 and tobacco rod 12 are axially aligned in an end-to-end relationship, preferably abutting one another. Filter element 22 also has a generally cylindrical shape, and the diameter thereof is essentially equal to the diameter of the overwrapped tobacco rod 12. The filter element 22 comprises a filter material 26 circumscribed with an overlapping paper plug wrap 28, the overlapping portions of which are bonded together with a filter plug wrap adhesive.

Tipping paper 24 may circumscribe both the entire length of the filter element 22 and an adjacent region or length of the overwrapped tobacco rod 12. The inner surface of the tipping paper 24 is secured to the outer surface of the plug wrap 28 and a portion of the outer surface of the wrapping material 16 of the tobacco rod, using a suitable tipping paper adhesive. Typically, the filter element 22 has a length that ranges from about 20 mm to about 35 mm and a circumference of about 16 mm to about 28 mm. The filter material 26 can be any suitable material such as cellulose acetate, polypropylene, tobacco material, or the like. The smokable filler material 14 employed in the manufacture of the smokable rod can vary as is known in the art and may be preferably an "American blend" of tobacco materials. As used herein, "packing density" means the weight of the filler material that occupies a unit volume within the smokable rod. For smoking articles according to this invention, the packing density generally ranges from about 100 mg/cm$^3$ to about 300 mg/ cm$^3$. The cigarette 10 may be provided with an air dilution means, such as a series of perforations 29, each of which extend through the tipping material 24 and plug wrap 28.

Typical wrapping materials 16 are paper materials which contain about 55 to about 95 weight percent, preferably about 65 to about 90 weight percent cellulosic material; and about 5 to about 45 weight percent, preferably about 10 to about 35 weight percent inorganic filler. The preferred inorganic filler is calcium carbonate, although other fillers and combinations of other fillers with calcium carbonate can be employed. Preferred paper wrapping materials contain up to about 45 percent, more preferably up to about 35 percent, and most preferably about 25 to about 35 percent, by weight of calcium carbonate. The inorganic filler provides a desired opacity to the paper. The preferred papers also contain flax fibers, wood pulp, esparto fiber, sisal fibers, or other cellulosic material to provide a cellulosic base web. Mixtures of two or more types of cellulosic materials can be employed. The selection of inorganic fillers and cellulosic materials for the manufacture of smokable rod wrapping materials will be apparent to the skilled artisan.

The cigarette wrapper 16 is provided preferably on its inside surface with one or more cross-directional or circumferential bands 30 of an adhesive, such as a cigarette seam adhesive, filter plug wrap adhesive or tipping paper adhesive. If desired, the adhesive bands 30 may be applied on the outside surface of the cigarette wrapper 16 as shown in dashed lines in FIG. 1. The bands 30 preferably have a width longitudinally of the cigarette 10 of more than 2 mm and preferably a width from about 5 mm to about 20 mm. When there are two or more bands 30 applied to the wrapper, the bands are spaced apart along the longitudinal axis A of the cigarette more than about 10 mm, preferably from about 20 mm to about 25 mm. The bands 30 do not, but may, extend to the longitudinal edges of the cigarette wrapper 16, and preferably extend to about 1 mm from each edge of the wrapper thereby leaving about a 1 mm adhesive gap at each edge. The weight of a single band 30 of the applied adhesive on a cigarette wrapper 16 may vary, but is preferably in the range of from about 1 mg to about 1.5 mg.

The porosity of the paper wrapper 16 at the region of the paper where the adhesive bands 30 are applied is preferably less than 20 Coresta units and may be from about 0 Coresta units to about 20 Coresta units, preferably from about 0 Coresta units to about 10 Coresta units, and most preferably from about 0–6 Coresta units. The thickness of the applied adhesive bands 30 must be sufficient to achieve an appropriate porosity to accomplish reduced ignition propensity of a smoking article, but is not critical to practice of the invention. Nevertheless, for use in the manufacture of cigarettes, the band thickness, whether applied in line or off line, or on the inside or outside of the cigarette wrapper, must be compatible with high speed cigarette manufacture with respect to, for example, wrapping the tobacco rod in the garniture of the cigarette maker and, in the case of in line adhesive application, drying of the adhesive.

The adhesive bands 30 are formed on the paper by application of a conventional adhesive formulation to one surface of the paper wrapper, preferably to that surface of the paper that will become the inside surface of the cigarette wrapper as described in more detail hereinafter. Such adhesive formulation may be the cigarette seam adhesive used to bond together the overlapping portions of the wrapper 16 along the longitudinal seam of the cigarette, the filter plug wrap adhesive used to bond together the overlapping portions of the filter plug wrap 28, or the tipping paper adhesive used to bond the tipping paper 24 to the outer surfaces of the plug wrap 28 and the paper wrapper 16. Preferably, the cigarette seam adhesive is used for the bands 30 because of its known compatibility and physical characteristics when applied as the adhesive for the longitudinal seam of the paper wrapper 16.

One cigarette seam adhesive formulation suitable for application to the paper wrapper 16 to form the bands 30 is an adhesive formulated by the assignee of the present invention under the designation CS-1242. The CS-1242 formulation is an emulsion-based adhesive consisting of about 87%–88% by weight of an ethylene vinyl acetate (EVA) copolymer E sold under the designation Resyn 32-0272 by National Starch & Chemical Company of Bridgewater, N.J. and about 12%–13% by weight of an adhesive concentrate stabilizer known as AC-9 and made by the assignee of the present invention. The AC-9 adhesive concentrate stabilizer consists of about 92% by weight of water and solids of about 8% by weight of a polyvinyl acetate resin sold under the designation Airvol 205 by Air Products & Chemicals, Inc. of Allentown, Pa. The CS-1242 formulation has a viscosity in the range of from about 200 to about 600 centipoise, a percent by weight of solids from about 48% to about 50%, and a pH range from about 4.0 to about 6.0. It should be understood that variations in the foregoing weight percentages are possible depending on the film-forming capability of the adhesive (the reduction of permeability of the paper where the bands are applied) and the ability of the adhesive to be applied in line (the rheology, the drip and spatter resistance characteristics and the like).

The invention is not intended to be limited to the afore-described CS-1242 cigarette seam adhesive, but may be practiced using other adhesives that are conventionally used in the manufacture of cigarettes, or that may be developed for future use in the manufacture of cigarettes, or that may be developed specifically for use according to the present invention. For example, many other types of adhesives have been used as cigarette seam adhesives and; in general, have viscosity ranges from about 100 centipoise to about 3000 centipoise, solids content ranges of from about 40% to about 65%, and pH ranges from about 2.5 to about 9.0. A typical range of properties for an emulsion type cigarette seam adhesive used on a high speed (about 8000 cigarettes per minute) cigarette maker is a viscosity of about 200 to 1000 centipoise, a solids content of about 47% to 55% by weight and a pH of about 4.0 to 6.0.

tured by The Ecusta Division of the Glutfelter Company of Pisgah Forest, N.C. under the paper designations 456 (Tests 1 and 2 of the invention cigarettes) and 454 (Tests 3, 4 and 5 of the invention cigarettes). For the invention cigarettes, cross-directional bands of the CS-1242 cigarette seam adhesive described above were applied to the inside surfaces of the 456 and 454 cigarette papers in 5 mm widths spaced apart 20 mm. The invention cigarettes were wrapped on the Lab Protos maker with the adhesive banded papers and a filter was added to each of the cigarettes with tipping paper in a conventional manner. The control and invention cigarettes of Tests 1, 2, 3 and 4 were tested on 10 layers of Whatman #2 filter paper in accordance with the Cigarette Extinction Test Method of the National Institute of Standards and Technology (NIST). The control and invention cigarettes of Test 5 were tested on 3 layers of Whatman #2 filter paper also in accordance with the NIST Cigarette Extinction Test Method. The results of these tests are shown below in Table I.

TABLE I

| | | | | Number of Cigarettes Which | | | | | | | | | | | | | | | | |
|---|---|---|---|---|---|---|---|---|---|---|---|---|---|---|---|---|---|---|---|---|
| | SE in holder* | SE on Substrate* | Full Length Burn | Burnt Completely Through Number of Affected Layers | | | Burnt but Not Completely Through Number of Affected Layers | | | Heavily Scorched Number of Affected Layers | | | Scorched Number of Affected Layers | | | Lightly Scorched Number of Affected Layers | | | Barely Scorched Number of Affected Layers | | |
| Test 1 | | | | 2 | 1 | 3 | 2 | 1 | 3 | 2 | 1 | 3 | 2 | 1 | 3 | 2 | 1 | 3 | 2 | 1 |
| Invention Cigarettes | 2 | 5 | 1 | | 2 | 1 | 2 | 1 | 4 | | | 3 | 2 | 1 | | 2 | 4 | | | 1 |
| Control Cigarettes | 0 | 0 | 8 | | 6 | 2 | 6 | | 8 | | | 8 | | | | 1 | 6 | | | |
| Test 2 | | | | 1 | 2 | 3 | 2 | 1 | 3 | 2 | 1 | 3 | 2 | 1 | 3 | 2 | 1 | 3 | 2 | 1 |
| Invention Cigarettes | 2 | 6 | 0 | | | | 1 | 1 | 3 | 2 | | 5 | 1 | | 1 | 5 | | | 1 | 5 |
| Control Cigarettes | 0 | 0 | 8 | 1 | 3 | 4 | 4 | | 8 | | | 7 | 1 | | | 2 | 4 | | | |
| Test 3 | | | | 2 | 1 | 3 | 2 | 1 | 3 | 2 | 1 | 3 | 2 | 1 | 3 | 2 | 1 | 3 | 2 | 1 |
| Invention Cigarettes | 1 | 7 | 0 | | | | 1 | 1 | 2 | | 1 | 5 | 2 | | | 6 | 1 | | | 5 |
| Control Cigarettes | 0 | 0 | 8 | | 7 | | 7 | 1 | 8 | | | 8 | | | | 2 | 6 | | | |
| Test 4 | | | | 2 | 1 | 3 | 2 | 1 | 3 | 2 | 1 | 3 | 2 | 1 | 3 | 2 | 1 | 3 | 2 | 1 |
| Invention Cigarettes | 1 | 7 | 0 | | | | 1 | | 2 | | 2 | 5 | | 2 | 1 | 6 | | | | 7 |
| Control Cigarettes | 0 | 0 | 8 | 2 | 4 | | 6 | 2 | 8 | | | 8 | | | | 3 | 4 | | | |
| Test 5** | | | | 2 | 1 | 3 | 2 | 1 | 3 | 2 | 1 | 3 | 2 | 1 | 3 | 2 | 1 | 3 | 2 | 1 |
| Invention Cigarettes | 2 | 4 | 2 | 2 | 2 | | | 2 | | 1 | | | | 2 | | | 1 | | | 1 |
| Control Cigarettes | 0 | 0 | 8 | 4 | 4 | | | 4 | | | | | | | | | | | | |

*SE = self-extinguished

The following example illustrates the invention:

EXAMPLE 1

Five sets of eight Camel® Light 85 mm long cigarettes (the "control cigarettes") were manufactured on a Lab Protos cigarette making machine using standard commercial Camel7 Light 85 mm cigarette components and tested for ignition propensity in Tests 1–5 described below. Five sets of eight test cigarettes (Tests 1–5) of the invention (the "invention cigarettes") are manufactured on the same Lab Protos cigarette making machine using standard commercial Camel® Light 85 mm cigarette components, except for the paper wrappers. The paper wrappers for the invention cigarettes were conventional cigarette wrapper paper manufac- The results of Tests 1–5 set forth in Table I above yielded the following results. Two (2) cigarettes or 25% of the eight invention cigarettes of each of the Tests 1 and 2 self-extinguished in the holder and one (1) cigarette or 12.5% of the eight invention cigarettes of each of Tests 3 and 4 self-extinguished in the holder. The remaining invention cigarettes of Tests 2, 3 and 4 self-extinguished on the paper substrate, while in Test 1 five (5) of the invention cigarettes self-extinguished on the paper substrate and only one (1) invention cigarette had a full length burn. Therefore, in accordance with the test method used, 100% of the invention cigarettes in Tests 2, 3 and 4 self-extinguished and 88% of the invention cigarettes in Test 1 self-extinguished. In contrast, 100% of the control cigarettes in Tests 1–4 did not self-extinguish, but had a full length burn.

Test 5 was conducted with only three layers of paper substrate under the NIST test guidelines. Still, 75% of the invention cigarettes self-extinguished, while 100% of the control cigarettes did not self-extinguish, but had a full length bum.

Referring now to the schematic representation in FIG. 2 of the drawings, the method and apparatus of the invention will now be described. A portion of a conventional Hauni Protos cigarette maker manufactured by Körber of Germany is shown and designated generally by reference numeral 40. The modification to the maker 40 according to the present invention comprises an adhesive applicator apparatus that is designated generally by reference numeral 50. The maker 40 includes a large bobbin 42 with a paper strip or cigarette wrapper P wound thereon. Bobbin 42 is mounted for clockwise rotation beneath the maker garniture 44 and printer section 46. As the paper strip or wrapper P is unwound from the bobbin 42, it passes around an arrangement of rollers 48 to take up slack in the strip P and maintain a certain amount of tension on the paper strip as is well known in the art.

After the paper strip P passes through the printer section 46, it travels to the adhesive applicator apparatus 50 of the invention where it first passes through a paper preheater 52, preferably an infrared (IR) heater, where the paper is preheated to a temperature in the range of about 180° C. to about 220° C., preferably about 200° C. Preheating of the paper web P is optional, but preferred, especially in the case of a high speed cigarette maker where preheating the paper can advantageously assist in evaporating the solvent for the subsequently applied adhesive.

The preheated paper web P travels next to the adhesive applicator assembly 54, sometimes broadly referred to in the art as a "glue pot." The adhesive applicator assembly 54 comprises a pair of counter-rotating rollers 56, 58, which counter-rotate in the directions shown by the arrows in FIG. 2, and an adhesive feed shoe 60. A drip box 62 encloses the lower portions of the rollers 56, 58 to catch any adhesive that drips, spatters or is thrown by centrifugal force or otherwise from the rollers. Rollers 56, 58 are engaged to counter-rotate at identical peripheral speeds which also correspond to the speed of the paper strip P at the point T where the paper strip tangentially contacts the peripheral surface of roller 56. Speed control systems for moving and rotating machine components at precise predetermined speeds and for maintaining zero relative speed between moving and rotating machine components are well known in the art and need not be described further herein.

Roller 56 is an application roller and roller 58 is a pattern roller, preferably a gravure or intaglio pattern roller provided with a plurality of circumferentially spaced transverse grooves in a manner well known in the printing art. Adhesive feed shoe 60 is located between the counter-rotating rollers 56, 58 so as to feed an adhesive, such as a cigarette seam adhesive, filter plug wrap adhesive or tipping paper adhesive, to the pattern roller 58 immediately upstream of the nip between the rollers. As the rollers 56, 58 counter-rotate, the adhesive is transferred from the transverse grooves on the pattern roller 58 to the application roller 56 in circumferentially spaced locations on the peripheral surface of the application roller 56. The application roller 56 is positioned to bear with a slight upward pressure against the paper strip P at point T so as to transfer the adhesive to the preheated paper strip P in longitudinally spaced, cross-directional bands 30 (FIG. 1) of a predetermined width and spacing as described above.

After the adhesive has been applied to the paper strip P, the paper strip passes through an IR paper dryer 64 downstream of the adhesive applicator assembly 54 and upstream of the garniture 44 of the cigarette maker 40. After passing through the dryer 64, the paper strip P with the cross-directional bands 30 on one surface thereof travels via another arrangement of rollers 66 to the garniture 44 where it is formed about a tobacco rod and bonded along an overlapping longitudinal seam formed by the longitudinal side edges of the paper strip P. The adhesive and paper strip P are dried sufficiently in the IR paper dryer 64 and during passage over the roller arrangement 66 so that the paper with the spaced, cross-directional adhesive bands 30 applied to it does not tear when it is wrapped about the tobacco rod in the garniture 44.

It will be appreciated by those skilled in the cigarette making art that the adhesive applicator apparatus 50 shown in FIG. 2 will cause the adhesive bands 30 to be applied to the inside surface of the paper cigarette wrapper, i.e., the surface confronting the tobacco rod, as is preferred. However, it will also be appreciated that the adhesive applicator apparatus 50 can be arranged on the maker 40 so that the adhesive bands 30 will be applied to the outside surface of the paper cigarette wrapper if that is desired.

According to the method of the invention, longitudinally spaced, cross-directional bands of an adhesive are applied in line to a paper cigarette wrapper at a location between the paper bobbin and the garniture of a cigarette maker. The bands may be applied by rollers of an adhesive applicator apparatus as described above or may be applied by any other suitable process.

Although certain presently preferred embodiments of the invention have been specifically described herein, it will be apparent to those skilled in the art to which the invention pertains that variations and modifications of the various embodiments shown and described herein may be at made without departing from the spirit and scope of the invention. Accordingly, it is intended that the invention be limited only to the extent required by the appended claims and the applicable rules of law.

What is claimed is:

1. A method of making a cigarette smoking article having reduced ignition propensity comprising the steps of providing a cigarette maker having a garniture and a bobbin for paying out a paper wrapper to the garniture for wrapping about a rod of smokable material to form a cigarette rod, applying cross-directional bands of adhesive to the paper wrapper as it is payed out from the bobbin to the garniture, the adhesive being applied in sufficient amounts to reduce the porosity of the paper wrapper to less than 20 Coresta units in a region where the adhesive band is applied to the paper wrapper, and wrapping the paper wrapper about a rod of smokable material with the adhesive bands disposed over the smokable material.

2. The method of claim 1, wherein the adhesive is one of a cigarette seam adhesive, a filter plug wrap adhesive or a tipping paper adhesive.

3. The method of claim 1, wherein the paper wrapper has a porosity of less than 10 Coresta units in a region where the adhesive band is applied to the paper wrapper.

4. The method of claim 3, wherein the paper wrapper has a porosity of less than 6 Coresta units in a region where the adhesive band is applied to the paper wrapper.

5. The method of claim 1, wherein the adhesive applied in a band is in the amount between 1 mg and 1.5 mg.

6. The method of claim 1, wherein the adhesive is applied to a surface of the paper wrapper such that the adhesive is wrapped in direct contact with the rod of smokable material.

7. The method of claim 1 further comprising preheating the cigarette paper to a temperature between 180° F. and 220° F. before adhesive is applied.

8. The method of claim 1 further comprising providing a polyvinyl alcohol stabilized, ethylene vinyl acetate copolymer emulsion-based adhesive.

9. The method of claim 1 further comprising formulating an emulsion-based adhesive having a viscosity of about 200 to about 1000 centipoise and a solids content between 47% and 55% by weight.

* * * * *